United States Patent [19]

Bolton

[11] Patent Number: 4,494,812

[45] Date of Patent: Jan. 22, 1985

[54] WIRE BRUSH BATTERY CONNECTOR

[76] Inventor: John D. Bolton, 5 Shiloh Cir., Irvine, Calif. 92714

[21] Appl. No.: 444,425

[22] Filed: Mar. 14, 1983

[51] Int. Cl.[3] ..... H01R 4/26; H01R 11/28

[52] U.S. Cl. ..... 339/95 B; 339/228

[58] Field of Search ..... 339/228, 277 R, 277 C, 339/278 C, 256 R, 256 RT, 95 B; 15/104.04, 106, 160, 200

[56] References Cited

U.S. PATENT DOCUMENTS

| | | | |
|---|---|---|---|
| 996,519 | 6/1911 | Peter | 15/104.04 |
| 2,793,350 | 5/1957 | Anderson | 339/95 B |
| 3,527,611 | 9/1970 | Newfarmer | 15/104.04 |

*Primary Examiner*—John McQuade
*Assistant Examiner*—Paula Austin

[57] ABSTRACT

This invention is an apparatus to make the connection of a wire to an electric power source terminal consisting of a metal ring with a plurality of metallic wires projecting from the inside of the ring toward the center of the ring.

3 Claims, 2 Drawing Figures

WIRE BRUSH BATTERY CONNECTOR

FIELD OF THE INVENTION

This is an apparatus to make a connection of a wire to an electric power source.

DESCRIPTION OF THE PRIOR ART

At the present state of the art, motor vehicle battery connections rely on various screw and clamping devices to get enough pressure between the connector and the battery post to permit adequate flow of electricity. They all require some time and tools to install. Battery posts are not standard and the clamping connectors do not fit all sizes of posts. To install a specific battery in a specific vehicle frequently requires removing the existing terminals and purchasing new smaller or larger connectors and then soldering the many wires onto them. This may be an impossible task because the area is remote, stores are closed, or the user may not have available the tools skills or time to effectuate a series of soldered connections.

The build up of corrosion products between the terminal and connection is a very common problem. It disrupts the flow of electricity and frequently prevents the whole vehicle from starting or running. There is no way to remove that extraneous material without removing the battery connection from the terminal and then scraping out the terminal and scraping off the post. Although it can be done with common tools it is difficult to do without special tools which most people do not possess.

SUMMARY OF THE INVENTION

This invention is an apparatus to make the connection of a wire to an electric power source terminal consisting of a metal ring with a plurality of metalic wires projecting from the inside of the ring toward the center of the ring.

It is the object of my invention to provide an apparatus that will permit the user to quickly and conveniently connect a wire to an electric power source without the use of tools. A second object of my invention is to provide an apparatus that will fit a wide range of sizes of electric terminals. A third object of my invention is to provide an apparatus that will permit the user to quickly and coinveniently remove the corrosion that frequently appears between an electric connector and an electric power source terminal without tools.

DESCRIPTION OF THE PREFERRED EMBODIMENT

Figure 1:
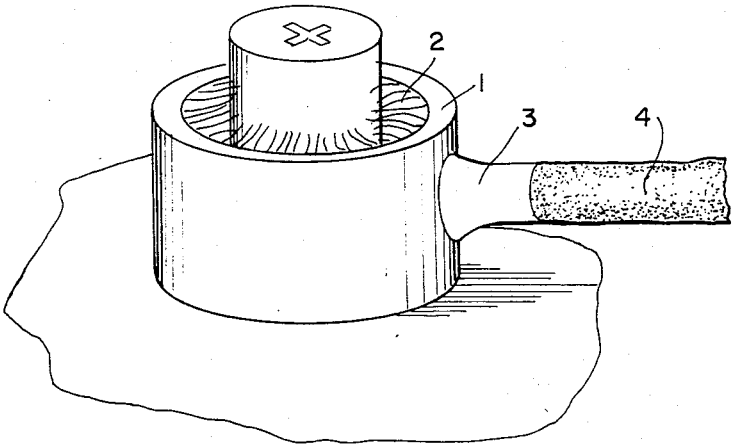
FIG. 1 is a perspective view of my battery terminal.
Figure 2:
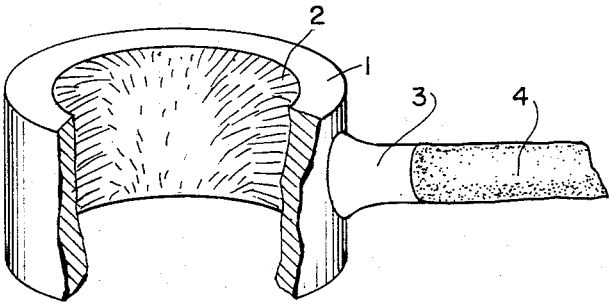

In describing the operation of one selected embodiment of my invention, specific terminology is resorted to for the sake of clarity. However, it is not intended to be limited to the specific terms so selected and it is to be understood that each specific term includes all technical equivalents which operate in a similar manner to accomplish a similar purpose.

Turning now to the specific embodiment of my invention chosen for illustration,

1 is a relatively heavy metal ring,
2 is one of a plurality of springy metal wires,
3 is the area where the load wire is connected to the battery connector,
4 is the load wire.

OPERATION OF THE APPARATUS

The manufacturer makes the ring larger than the post he wishes to connect to. The length of the wires is slightly more than half the difference in the distance of the diameter of the ring less the diameter of the post. The diameter of the battery post, the diameter of the ring and length of projecting wires have to be arranged so that the wires exert considerable pressure on the battery post, in fact dig into the post, but not so much pressure that it is impossible to rotate the connector on the post. The wires should be slightly arched when installed on the battery post and retain their springy nature for a long time.

In use the user presses the connector over the power source post in such a way that the post projects up through the center of the connector. The user may give a few partial rotations to clean the post and seat the wires well into the post. To remove the connector he pulls it off.

Occasionally to prevent the build up of corrosion and extraneous material the user gives the connector a few partial or complete rotations. The wire brushing action of the many bristles loosens the scale which falls away through the wires thereby restoring good electrical conductivity. The user may occasionally remove the connector, tap it on some hard object to shake the scale out of it, blow through it a few times and push it back onto the the post.

There are several advantages to my invention. First, one connector can fit a wide range of sizes of power source posts. A second advantage of my invention is that the connection can be quickly attached without any tools. A third advantage of my invention is that scale can be removed quickly, conveniently and without using any tools at all.

It is to be understood that the form of my invention herewith shown and described is to be taken as the preferred embodiment. For example, equivalent parts may be substituted for those described without departing from the spirit or scope of my invention. The main body ring may not be metal, but may be another material. The wires may be single strand or a plurality of wires wraped together to form larger individual wires.

Having thus described and disclosed my invention I claim:

1. An apparatus for connecting a wire to a power source or load post comprising a wire electrically connected to a metal ring, with a plurality of metal wires projecting from the internal surface of said ring.

2. The apparatus of claim 1 and where the said wires projecting generally toward the center of the said ring.

3. The apparatus of claim 2 and where the said wires are of a springy nature.

* * * * *